US008291848B2

(12) United States Patent
Fenini et al.

(10) Patent No.: US 8,291,848 B2
(45) Date of Patent: Oct. 23, 2012

(54) TRACTION METHOD FOR OPERATING LINES, IN PARTICULAR MOORING AND/OR PRODUCTION LINES, OF A FLOATING PRODUCTION UNIT

(75) Inventors: Alessandro Fenini, Vizzolo Predabissi (IT); Gianfranco Gamba, Bergamo (IT)

(73) Assignee: SAIPEM S.p.A., San Donato Milanese (IT)

( * ) Notice: Subject to any disclaimer, the term of this patent is extended or adjusted under 35 U.S.C. 154(b) by 0 days.

(21) Appl. No.: 12/385,794

(22) Filed: Apr. 20, 2009

(65) Prior Publication Data

US 2009/0260559 A1 Oct. 22, 2009

Related U.S. Application Data

(63) Continuation of application No. PCT/EP2007/061118, filed on Oct. 17, 2007.

(30) Foreign Application Priority Data

Oct. 18, 2006 (IT) ..... MI06A002000

(51) Int. Cl.
*B63B 21/00* (2006.01)

(52) U.S. Cl. ..... 114/230.25

(58) Field of Classification Search ..... 114/230.1, 114/230.12, 230.2, 230.22, 230.23, 230.25, 114/230.26

See application file for complete search history.

(56) References Cited

U.S. PATENT DOCUMENTS

| | | | | |
|---|---|---|---|---|
| 3,300,187 | A * | 1/1967 | Krogstad et al. | 254/284 |
| 3,470,057 | A | 9/1969 | Stuart et al. | |
| 4,257,718 | A | 3/1981 | Rosa et al. | |
| 4,574,023 | A | 3/1986 | Edwards et al. | |
| 5,395,454 | A | 3/1995 | Robert | |
| 6,044,787 | A | 4/2000 | Elmbo | |
| 6,065,781 | A | 5/2000 | Titus | |
| 6,440,245 | B1 | 8/2002 | Culzoni | |
| 7,093,860 | B2 | 8/2006 | Fawley | |
| 2005/0244578 | A1 | 11/2005 | Van Egmond et al. | |

FOREIGN PATENT DOCUMENTS

DE 102004056462 6/2006

(Continued)

OTHER PUBLICATIONS

International Search Report mailed Jan. 31, 2008 in Application PCT/EP2007/061118.

(Continued)

*Primary Examiner* — Daniel Venne

(74) *Attorney, Agent, or Firm* — Davidson Berquist Jackson & Gowdey, LLP

(57) ABSTRACT

A traction system for operating lines, in particular mooring lines and/or production lines, of a floating production unit has a number of work stations distributed along the unit, at least at two ends of the unit, and engaged by respective operating lines; a main winch; and a cable transmission device having a duty cable connected to the main winch, and guide means for selectively routing the duty cable to each work station for attachment to a respective operating line; at least one auxiliary winch, having an auxiliary cable connectable to the duty cable, is used to unwind the duty cable off the main winch and run the duty cable, along paths defined by the guide members, into a number of positions close to respective work stations.

7 Claims, 4 Drawing Sheets

FOREIGN PATENT DOCUMENTS

| | | |
|---|---|---|
| EP | 1013514 | 7/2000 |
| EP | 1217276 | 6/2002 |
| FR | 1394983 | 4/1965 |
| FR | 2723006 | 2/1996 |
| GB | 899644 | 6/1962 |
| GB | 2232740 | 12/1990 |

OTHER PUBLICATIONS

European Search Report mailed Apr. 29, 2008 in PCT Application No. PCT/EP2007/064524.
International Search Report and Written Opinion mailed Dec. 17, 2008 in PCT/IB2008/000863.
International Search Report and Written Opinion mailed Jul. 25, 2008 in PCT/IB2008/000441.
U.S. Appl. No. 12/448,194, filed Jun. 6, 2010 PTO Office Action.
International Search Report Apr. 29, 2008 in PCT/EP2007/064524.
International Preliminary Report on Patentability and Written Opinion in PCT Appln. No. PCT/EP2007/061118, mailed Apr. 22, 2009.
U.S. Appl. No. 12/448,194, filed Dec. 3, 2010 PTO Office Action.
U.S. Appl. No. 12/448,194, filed Mar. 31, 2011 PTO Office Action.

* cited by examiner

TRACTION METHOD FOR OPERATING LINES, IN PARTICULAR MOORING AND/OR PRODUCTION LINES, OF A FLOATING PRODUCTION UNIT

TECHNICAL FIELD

The present invention relates to a traction system for operating lines, in particular mooring and/or production lines, of a floating production unit, and to a floating production unit featuring such a system.

The invention also relates to a traction method for operating lines of a floating production unit, in particular for tensioning mooring lines and/or hoisting production lines of the unit; which method is particularly indicated for spread mooring floating production units.

BACKGROUND ART

Floating units, e.g. reconverted ships, are known to be used for off-shore oil extraction, are commonly known as floating production units (FPUs), and comprise so-called FSO (floating storage and offloading) units, and FPSO (floating production, storage and offloading) units.

A floating production unit is normally anchored permanently to the bottom by a number of mooring lines extending from respective mooring stations on the unit.

A mooring line normally comprises a first chain portion fixed to a mooring station by a fastening device; a cable portion (e.g. made of synthetic material); and a second chain portion terminating with an anchor.

Spread mooring is one of various known mooring configurations, and comprises two groups of mooring lines at respective ends of the unit (e.g. at the bow and stern, in the case of a reconverted ship).

Each mooring line must obviously be tensioned. In the case of spread mooring, this is done using a number of independent winches for respective mooring lines, or two winches, each located, and catering to a group of mooring lines, at a respective end of the unit. Both solutions employ hydraulic chain winches known as windlasses, i.e. vertical-axis winches with a chain-winding indented drum. As is known, winches of this sort are extremely bulky, complicated, expensive, and difficult to procure, so installing a number of them involves considerable cost and often fairly long delays awaiting delivery.

Moreover, unless each winch is equipped with its own electrohydraulic system, employing a number of hydraulic winches located at various points on the unit calls for a complex piping system to connect the winches to a common electrohydraulic system.

On known floating production units, the mooring line tensioning winches cannot be used for other purposes, in particular for hoisting any production lines the unit may be equipped with. As is known, oil production lines are normally gathered by a dedicated structure ("riser balcony") which, for hoisting and handling production lines in general, is equipped with special winches separate from and independent of the mooring line tensioning winches.

The known solutions described briefly above, as well as other similar solutions, therefore have a number of drawbacks.

DISCLOSURE OF INVENTION

It is an object of the present invention to eliminate the aforementioned drawbacks of the known art, and in particular to provide a traction system, for operating lines of a floating production unit, which is relatively cheap and simple, but at the same time efficient and reliable, and can be used specifically for tensioning mooring lines of the unit, as well as, if necessary, handling other operating lines, such as production lines.

It is a further object of the invention to provide a traction method, for operating lines of a floating production unit, which provides in particular, in a relatively straightforward, low-cost manner, for tensioning mooring lines and/or hoisting production lines of the unit.

According to the present invention, there is provided a traction system for operating lines, in particular mooring and/or production lines, of a floating production unit.

According to the present invention, there are also provided a floating production unit; and a traction method for operating lines of a floating production unit, in particular for tensioning mooring lines and/or hoisting production lines of the unit.

The system according to the invention, and the method employing the system, provide for tensioning individual mooring lines simply and reliably, using only one main cable winch, as opposed to two or more chain winches as in known solutions, thus greatly reducing system cost. More specifically, a horizontal-axis cable winch may be used, which, besides being simpler and cheaper, is also more compact. Using a single main winch also means the electrohydraulic system can be installed directly on the winch, thus eliminating the need for piping along the unit.

The system according to the invention also enables multipurpose operation of the main winch, in particular for tensioning mooring lines, but also for hoisting production lines.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
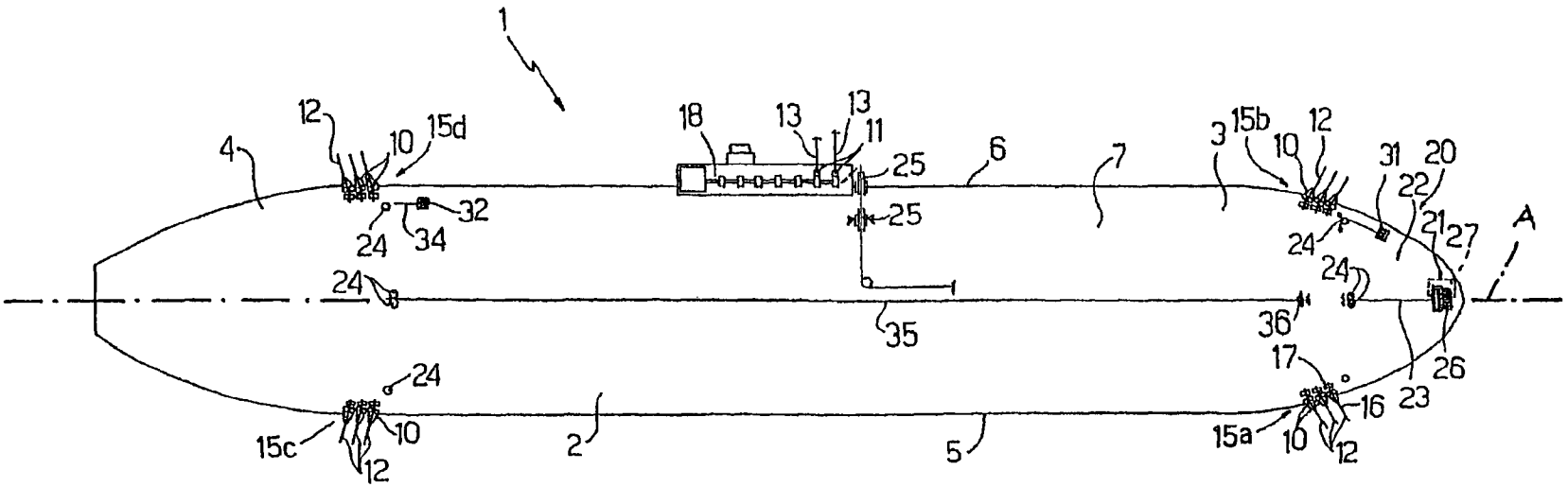
FIG. 1 shows a schematic top plan view of a floating production unit featuring an operating line (mooring and/or production line) traction system in accordance with the invention.

Number 1 in FIG. 1 indicates as a whole a so-called FPSO floating production unit defined, for example, by a reconverted ship. Unit 1 comprises a hull 2 which extends along an axis A between two, respectively bow and stern, ends 3, 4, and has two sides 5, 6 and an upper deck 7.

Unit 1 comprises a number of work stations 10, 11 distributed along unit 1 and engaged by respective operating lines 12, 13. More specifically, work stations 10, 11 comprise mooring stations 10 arranged in a spread mooring configuration and engaged by respective mooring lines 12; and production stations 11 engaged by respective production lines 13. Both mooring and production stations 10 and 11 are substantially known and therefore not described or shown in detail for the sake of simplicity.

Mooring stations 10 are arranged in groups 15 at ends 3, 4 and on opposite sides 5, 6 of unit 1. The example shown comprises four groups 15*a*, 15*b*, 15*c*, 15*d* of mooring stations 10 located respectively on the right and left of the bow and on the right and left of the stern of unit 1; and each group 15 comprises one or preferably a number of mooring stations 10 located substantially on upper deck 7.

Each mooring line 12 comprises at least one end chain portion 16 fixed to a mooring station 10 by a known fastening device 17. The rest of mooring line 12 is substantially known (comprising, for example, after end chain portion 16, a cable portion of synthetic material, and a second chain portion terminating with an anchor) and therefore not shown.

Production stations 11 are fitted in a known configuration to a hoisting structure 18 known as a riser balcony, which is located along side 5 or 6 of unit 1, in an intermediate position between ends 3 and 4, and possibly at a different level—in particular, raised—with respect to upper deck 7.

Unit 1 comprises a traction system 20 for operating lines 12, 13, which, as explained below, is used for handling and tensioning mooring lines 12, as well as for handling and hoisting production lines 13.

System 20 comprises a main winch 21; and a cable transmission device 22 having a duty cable 23—in particular a metal (e.g. steel) cable—connected to main winch 21, and guide members 24, 25 for selectively routing duty cable 23 to each work station 10 for attachment to a respective operating line 12, 13.

Main winch 21 is a preferably (though not necessarily) horizontal-axis cable winch with a smooth or grooved drum 26 on which to wind duty cable 23, as opposed to a chain-winding indented drum.

Main winch 21 is located substantially on upper deck 7, in an area of unit 1 where equipment is not subject to specific explosion safety regulations (so-called "safe area"), and in particular in a non-exclusive safe area. In the example shown, main winch 21 is located at end 3 or 4 of unit 1, but may also be located in a safe area in the centre of unit 1.

In the example shown, main winch 21 is located substantially along axis A, but may obviously also be located to one side of unit 1, close to side 5 or 6, i.e. close to group 15*a* or 15*b*.

Main winch 21 is powered by a known electrohydraulic system 27 (only shown schematically in FIG. 1) located close to or at any rate in the vicinity of main winch 21.

System 20 also comprises two auxiliary winches 31, 32 located respectively at ends 3, 4, close to groups 15*b*, 15*d*, and having respective auxiliary cables 33, 34 (e.g. of synthetic material) connectable to duty cable 23 to unwind it off main winch 21 and haul it, along paths defined by guide members 24, 25, to a number of positions close to each work station 10, 11.

Transmission device 22 comprises vertical-axis guide members 24, in particular pulleys, for guiding duty cable 23, substantially parallel to upper deck 7, to mooring stations 10 and hoisting structure 18; and horizontal-axis guide members 25, e.g. pulleys, for guiding duty cable 23 vertically to hoisting structure 18, if this is not on a level with upper deck 7.

For example, transmission device 22 comprises: a variety of pulleys 24, lateral, auxiliary and central, for example, close to each group 15 of mooring stations 10; an auxiliary pulley 24 opposite each auxiliary winch 31, 32; and two side by side central pulleys 24 at each end 3, 4, in an intermediate position between lateral pulleys 24. Other pulleys 24, 25 are provided to route duty cable 23 to hoisting structure 18. Purely by way of example, these may include a central pulley 24 close to axis A at hoisting structure 18; a swivel pulley 25, e.g. with a universal joint, at one end of hoisting structure 18; and the pulley 25 substantially located over each production station 11.

It is understood that transmission device 22 may comprise guide members other than and arranged differently on unit 1 from those described and illustrated here purely by way of example.

Transmission device 22 also comprises a pilot cable 35 extending substantially parallel to axis A along unit 1, and connectable at opposite ends to duty cable 23 and/or auxiliary cables 33, 34. Pilot cable 35 may be housed in a channel formed on upper deck 7, and is guided, for example, by the central pulleys 24 at end 4, and by a guide member 36 at end 3.

The method of tensioning mooring lines 12 (i.e. for spread mooring unit 1) and/or hoisting production lines 13 is implemented by system 20 as follows.

Figure 2:
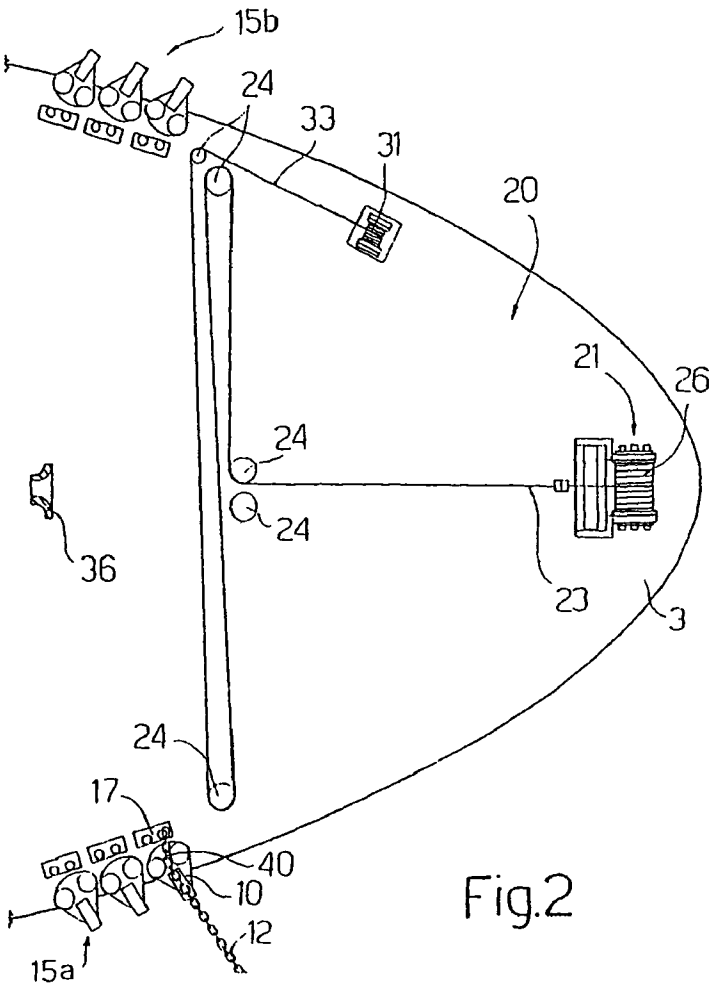

With reference to FIG. 2, a mooring line 12 is brought up beneath group 15*a* of mooring stations 10 of unit 1, e.g. by a tender, and is hoisted by auxiliary winch 31, by unwinding auxiliary cable 33 off auxiliary winch 31 and attaching it to the end 40 of mooring line 12. Auxiliary winch 31 is only used to hoist mooring line 12 up to mooring station 10 on upper deck 7 (without tensioning mooring line 12).

Figure 3:
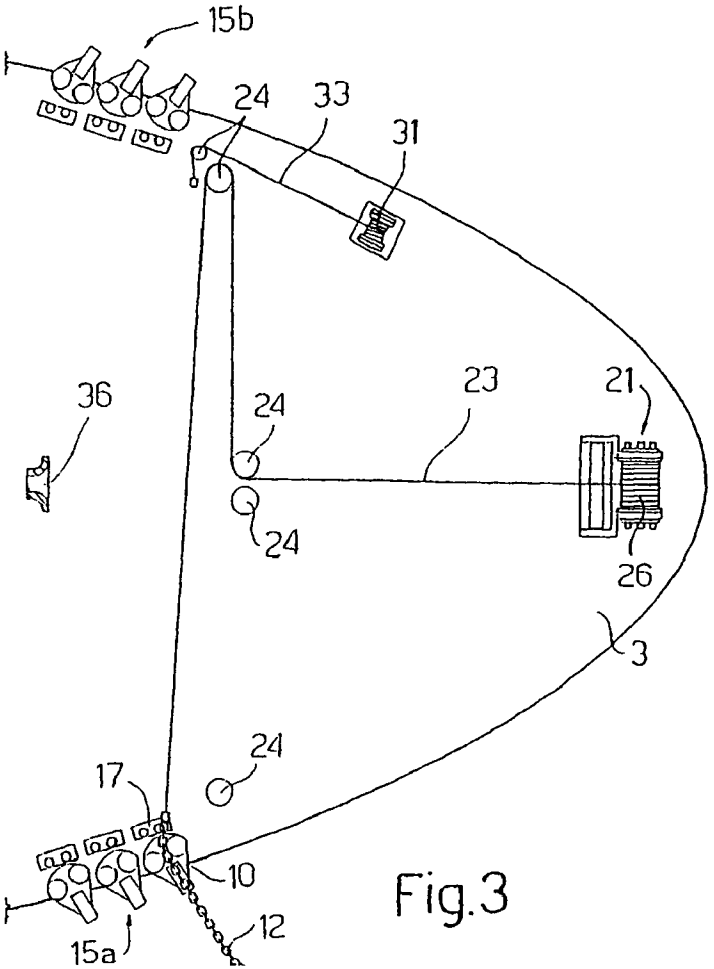
FIGS. 2-4 show a detail of the FIG. 1 unit at various operating stages of the system.

After detaching auxiliary cable 33 from mooring line 12 and attaching end 40 temporarily to mooring station 10, auxiliary cable 33 is guided by pulleys 24 to main winch 21 and attached to duty cable 23; duty cable 23 is hauled by auxiliary winch 31 up to the mooring station 10 being worked; duty cable 23 is detached from auxiliary cable 33 and attached to mooring line 12, as shown in FIG. 3; mooring line 12 is hauled in and tensioned by main winch 21; and, once mooring line 12 is locked by fastening device 17, duty cable 23 is detached and used for the other mooring lines 12 in the same group 15*a*.

Figure 4:
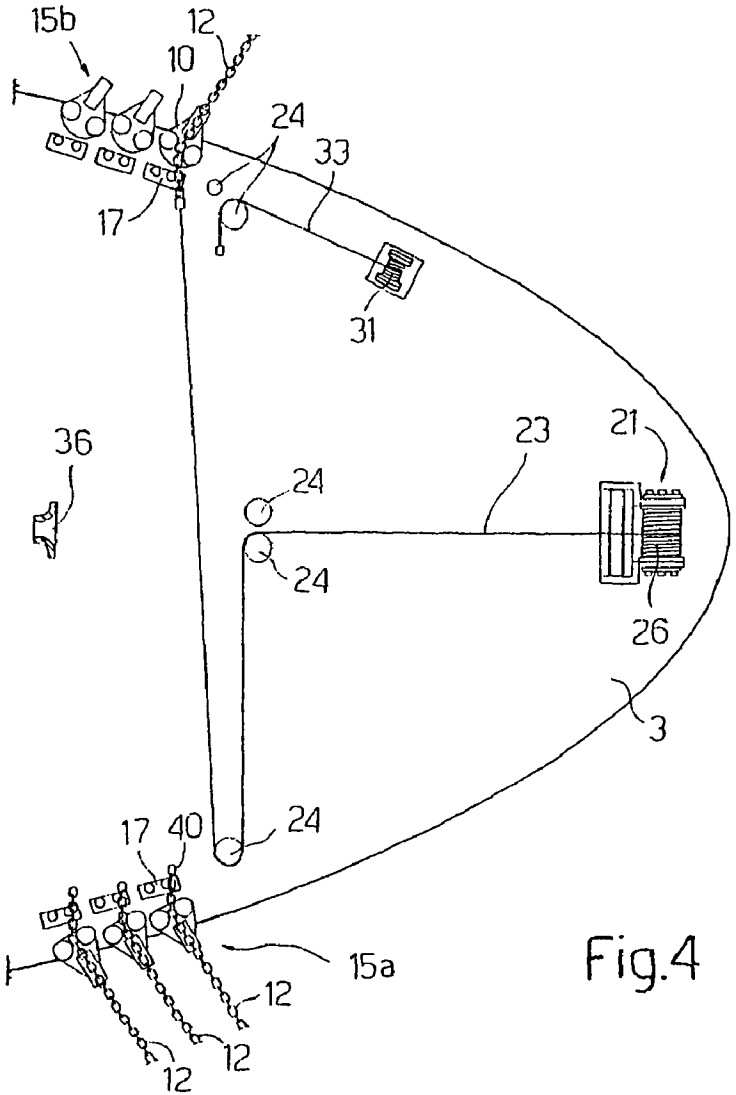

To tension mooring lines 12 in group 15*b* (left of the bow), auxiliary cable 33 is run along another path, also defined by pulleys 24, and attached to duty cable 23 (which, in the meantime, has been partly rewound onto main winch 21); and auxiliary winch 31 hauls duty cable 23 up to group 15*b* where the tensioning routine is repeated for each mooring line 12 (FIG. 4).

Figure 5:
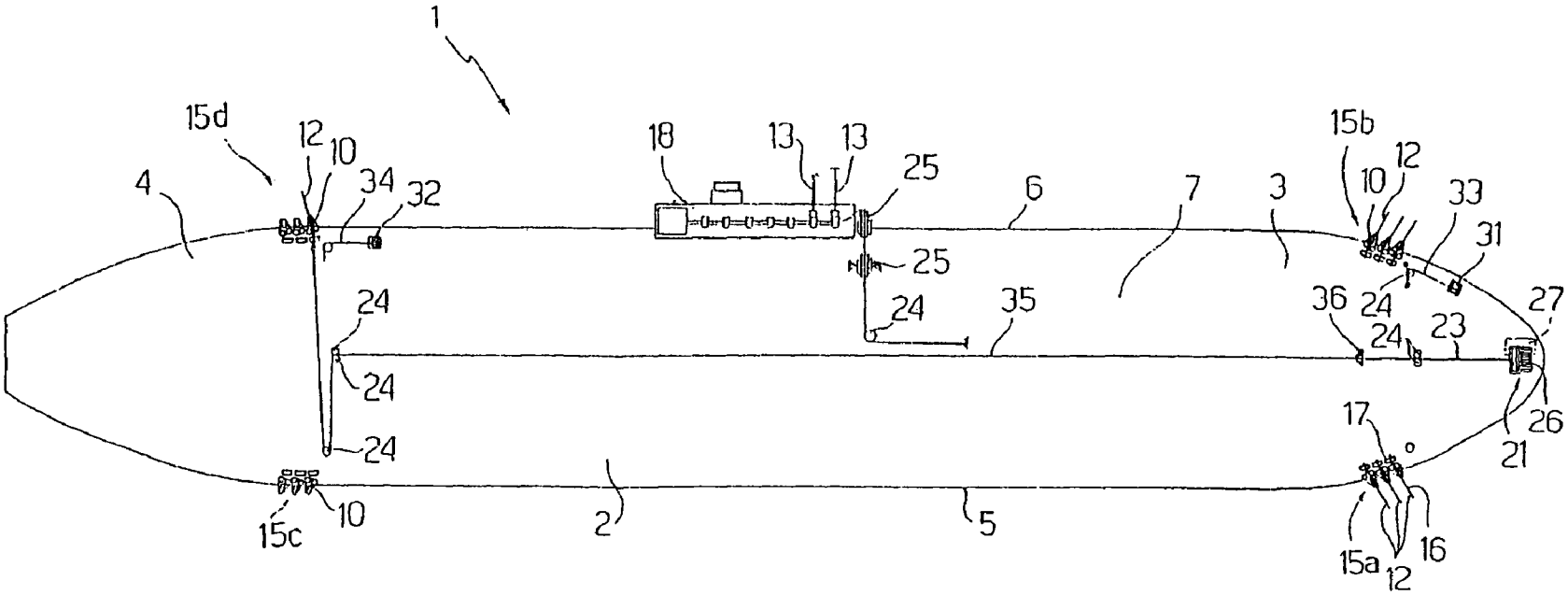
FIG. 5 shows a schematic of the FIG. 1 unit at further operating stages of the system.

To haul duty line 23 to end 4, i.e. to groups 15*c*, 15*d* of mooring stations 10, auxiliary cable 34 is run along a path defined by pulleys 24; auxiliary cable 34 is attached to pilot cable 35, and pilot cable 35 to duty cable 23; and duty cable 23 is hauled by auxiliary winch 32 into position for attachment to mooring lines 12 (FIG. 5).

Duty cable 23 and main winch 21 are also used for hoisting production lines at production stations 11. For example, to attach duty cable 23 to production lines 13 at production stations 11, auxiliary cable 34 of auxiliary winch 32 is run out (possibly with the aid of a further pilot cable not shown) along a path defined by pulleys 24, 25, and is attached to duty cable 23.

The invention claimed is:

1. A traction method for operating lines of a floating production unit which extends along an axis A between two ends, and having a plurality of work stations distributed and spaced apart along the floating production unit and at least at two ends thereof, each of the plurality of work stations being engaged by at least one of a plurality of operating lines for tensioning and/or hoisting mooring lines and production lines of the floating production unit, the method including the steps of:

providing only a single cable winch adjacent one end of the floating production unit and having a single duty cable operatively connected thereto;

positioning a transmission device comprised of a plurality of guide members at predetermined locations on the floating production unit to provide paths of travel for the single duty cable and selectively routing the single duty cable to respective ones of the plurality of work stations;

positioning a first auxiliary winch adjacent an end of the floating production unit at which the single cable winch is located;

positioning a second auxiliary winch adjacent an opposite end of the floating production unit at a distance from the location of the single cable winch, operatively connecting a respective auxiliary cable to each of the first and second auxiliary winches and selectively connecting an auxiliary cable from one or both of the first and second auxiliary winches to mooring and production lines adjacent their respective locations on the floating production unit, to hoist such lines to an adjacent work station, connecting the auxiliary cable of the first auxiliary cable winch to the single duty cable and unwinding the single duty cable off of the single cable winch by operation of the first auxiliary winch, running the single duty cable along paths defined by at least a first set of the plurality of guide members, into a position close to a work station adjacent the location of the first auxiliary winch and then connecting the single duty cable to a line hoisted to that work station and tensioning the line that had been hoisted to that work station by pulling the single duty cable onto the single cable winch;

subsequently connecting the auxiliary cable of the second auxiliary winch to one end of a pilot cable extending substantially parallel to the axis and between said opposite ends of the floating production unit;

connecting an opposite end of the pilot cable to the single duty cable;

pulling the single duty cable by the second auxiliary cable winch along paths defined by at least a second set of the plurality of guide members to the distant end of the floating production unit into a position close to a work station adjacent the location of the second auxiliary winch;

connecting the single duty cable to a line hoisted to that work station adjacent the location of the second auxiliary winch and tensioning the line that had been hoisted to that work station by pulling the single duty cable onto the single cable winch.

2. The method as in claim 1 wherein the single cable winch is wound on a horizontal-axis winch.

3. The method as in claim 1 including locating at least first and second work stations among the plurality of work stations at spaced apart positions on the floating production unit with said first and second work stations each comprising mooring stations operatively connected to mooring lines.

4. The method as in claim 1 further including the steps of locating at least first and second work stations among the plurality of work stations substantially on a level with the single cable winch, and pulling the single duty cable through a series of vertical-axis guide members thereby guiding the single duty cable to said first and second work stations.

5. The method as claimed in claim 4, including the steps of fitting a group of third work stations among the plurality of work stations to a hoisting assembly and locating the hoisting assembly on a different level of the floating production unit with respect to the location of the single cable winch, and pulling the single duty cable further through a series of horizontal-axis guide members thereby guiding the single duty cable vertically onto the hoisting assembly.

6. The method as claimed in claim 5, wherein the group of third work stations are operatively connected to production lines.

7. The method as claimed in claim 1, including the step of providing the single cable winch with a substantially smooth or grooved drum surface.

* * * * *